US007168372B2

(12) United States Patent
Fotia

(10) Patent No.: US 7,168,372 B2
(45) Date of Patent: Jan. 30, 2007

(54) EXPANDABLE AND COLLAPSIBLE TABLE

(75) Inventor: Frank M. Fotia, Anoka, MN (US)

(73) Assignee: Standalone, Inc., Brooklyn Park, MN (US)

( * ) Notice: Subject to any disclaimer, the term of this patent is extended or adjusted under 35 U.S.C. 154(b) by 248 days.

(21) Appl. No.: 10/783,683

(22) Filed: Feb. 20, 2004

(65) Prior Publication Data

US 2005/0183640 A1 Aug. 25, 2005

(51) Int. Cl.
*A47B 1/04* (2006.01)

(52) U.S. Cl. ..... 108/80; 108/82; 108/77

(58) Field of Classification Search ..... 108/79, 108/115, 77, 80, 81, 82; 248/188.6, 240.4
See application file for complete search history.

(56) References Cited

U.S. PATENT DOCUMENTS

| | | | | | |
|---|---|---|---|---|---|
| 376,594 | A | * | 1/1888 | Harter | 108/81 |
| 408,967 | A | * | 8/1889 | Garretson | 108/81 |
| 846,143 | A | * | 3/1907 | Ridgely | 108/80 |
| 1,803,545 | A | * | 5/1931 | Casper | 108/81 |
| 2,578,922 | A | * | 12/1951 | Cramer | 108/82 |
| 2,594,262 | A | * | 4/1952 | Howe | 108/81 |
| 2,835,522 | A | * | 5/1958 | Serto | 108/82 |
| 3,113,533 | A | * | 12/1963 | Snow | 108/134 |
| 3,148,639 | A | * | 9/1964 | Otilio et al. | 108/169 |
| 3,669,031 | A | | 6/1972 | Cole | |
| 4,102,555 | A | | 7/1978 | Tobolski | |
| 4,170,182 | A | | 10/1979 | Button | |
| 4,607,656 | A | | 8/1986 | Carter | |
| 4,676,174 | A | | 6/1987 | Dingeldey | |
| 4,840,340 | A | * | 6/1989 | Gustafsson et al. | 108/82 |
| 5,052,308 | A | | 10/1991 | Brown | |
| 5,131,547 | A | | 7/1992 | Goldberg | |
| 5,794,546 | A | | 8/1998 | Carter | |
| 5,865,127 | A | | 2/1999 | Carter | |
| 5,943,965 | A | | 8/1999 | Riach et al. | |
| 6,079,338 | A | | 6/2000 | Yeh | |
| 6,295,987 | B1 | | 10/2001 | Parker et al. | |
| 6,349,962 | B1 | | 2/2002 | Johanson | |
| 6,431,091 | B1 | | 8/2002 | Chang | |
| 6,431,092 | B1 | | 8/2002 | Stanford | |
| 6,494,147 | B1 | | 12/2002 | Schulte et al. | |
| 6,546,978 | B2 | | 4/2003 | Thoman | |
| 6,550,404 | B2 | | 4/2003 | Stanford | |
| 6,626,119 | B2 | | 9/2003 | Wilton | |

* cited by examiner

*Primary Examiner*—Jose V. Chen
(74) *Attorney, Agent, or Firm*—Nawrocki, Rooney & Sivertson, P.A.

(57) ABSTRACT

An expandable and collapsible table for use with a miter saw or for recreational use. A support structure includes a truss that is expandable and collapsible in the horizontal direction. A pair of expansion leaves are pivotally connected to opposing sides of the support structure. A support arm and extension arm work in combination with a locking mechanism to maintain the expansion leaves in the horizontal position or alternatively to allow the expansion leaves to collapse to a vertical position.

17 Claims, 10 Drawing Sheets

10
14
41
100
83
82
42
50
71
73
76
12
101
92
84
45
75
74
78
87
76
76
98
111
46
101
101
111
76
78
76
76
92
80
45
101
16
12
22
81

104
100
86
14
98
96
12
34
56
32
28
26

EXPANDABLE AND COLLAPSIBLE TABLE

BACKGROUND OF THE INVENTION

1. Technical Field

The present invention relates generally to the field of collapsible and portable table assemblies. More particularly, the present invention relates to a collapsible table assembly configured for use with miter saws and the like.

2. Description of the Prior Art

A collapsible table allows for easy storage and portability of a table in a collapsed configuration, and easy assembly of the table when occasioned for use.

A typical utility table is shown, for example, in U.S. Pat. No. 6,550,404 to Stanford wherein a pair of foldable legs are pivotally connected to the underside of the table top surface. The portability of such tables is limited, due to the bulk of the table top surface.

In order to improve the portability of collapsible tables, and decrease the bulk, a collapsible truss framework has been used in conjunction with a foldable table top, as disclosed in U.S. Pat. No. 5,865,127 to Carter, U.S. Pat. No. 5,794,546 to Carter and U.S. Pat. No. 6,349,962 to Johanson. A problem with collapsible trusses, is that the size of a table top utilizing a collapsible truss is limited by the length of the truss arms. More specifically, the length of the truss arms are limited by the height of the table.

Additional table top space can be made available through the use of side leaves that extend from a center table top leaf. Although lacking a collapsible truss framework, U.S. Pat. No. 6,494,147 to Schulte et al. discloses side leaves that are supported by a pivotal support structure having a horizontal component for contacting the underside of the leaves, and a vertical component for supporting the leaves. These support structures are rather bulky, and may present, for example, a tripping hazard to users of the table.

SUMMARY OF THE INVENTION

The present invention provides an expandable and collapsible table, such as for use with a miter saw, or for recreational use.

In an expanded configuration, a truss is expanded in the horizontal direction to provide a support structure for receiving a center table top surface. A pair of side leaves are pivotally connected to opposing sides of the support structure and are extended to a horizontal position. The side leaves are maintained in the expanded configuration by a support arm pivotally connected at opposing ends to a lower portion of the support structure and to an extension arm. The extension arm is pivotally connected at opposing ends to the support arm and to the expansion leaf. A locking mechanism maintains the support arm and extension arm in axial alignment, to provide an angled support for the expansion leaf.

The locking mechanism includes a pin extending from the support arm that is received within a slot in the extension arm. The locking mechanism is disabled by sliding the extension arm away from the support arm such that the pin engages the near end of the slot, with respect to the support arm. A transverse force will then cause the support arm and extension arm to pivot at the locking joint. An aperture in a portion of the support arm allows the extension arm the freedom to pivot from an axially aligned position to a substantially parallel position, with respect to the support arm.

In a collapsed configuration, the support arm and extension arm are substantially vertical, allowing the corresponding expansion leaf to pivot from the horizontal position to a vertical position. The center table top is removed from the support structure and the truss is collapsed in the horizontal direction, allowing the expandable and collapsible table to be easily transported and stored when not in use.

BRIEF DESCRIPTION OF THE DRAWINGS

FIG. 6 is a side elevational view of a portion of the invention from FIG. 1.

DETAILED DESCRIPTION OF THE PREFERRED EMBODIMENTS

Figure 1:
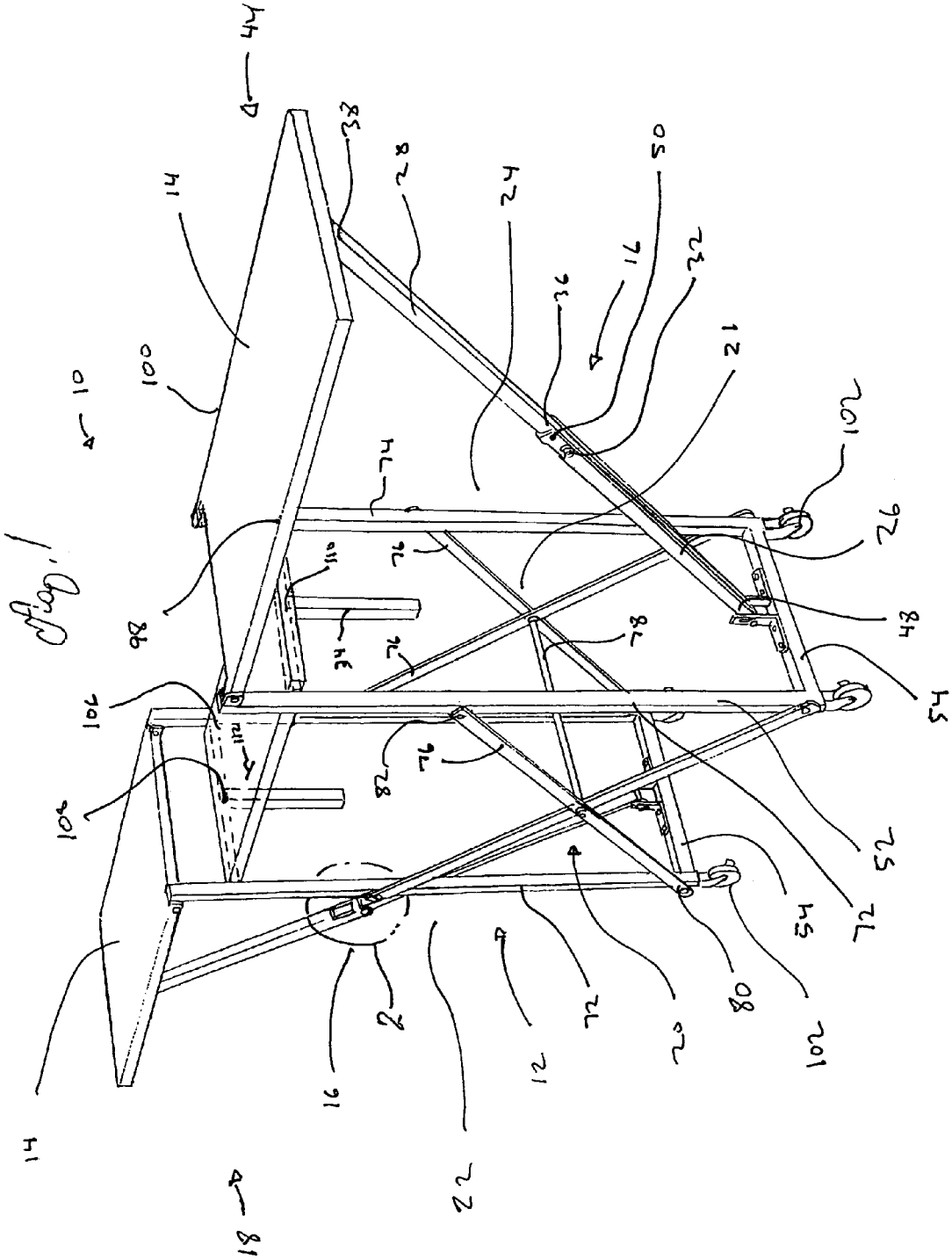
FIG. 1 is a perspective view of the present invention in an expanded configuration.
Figure 2:
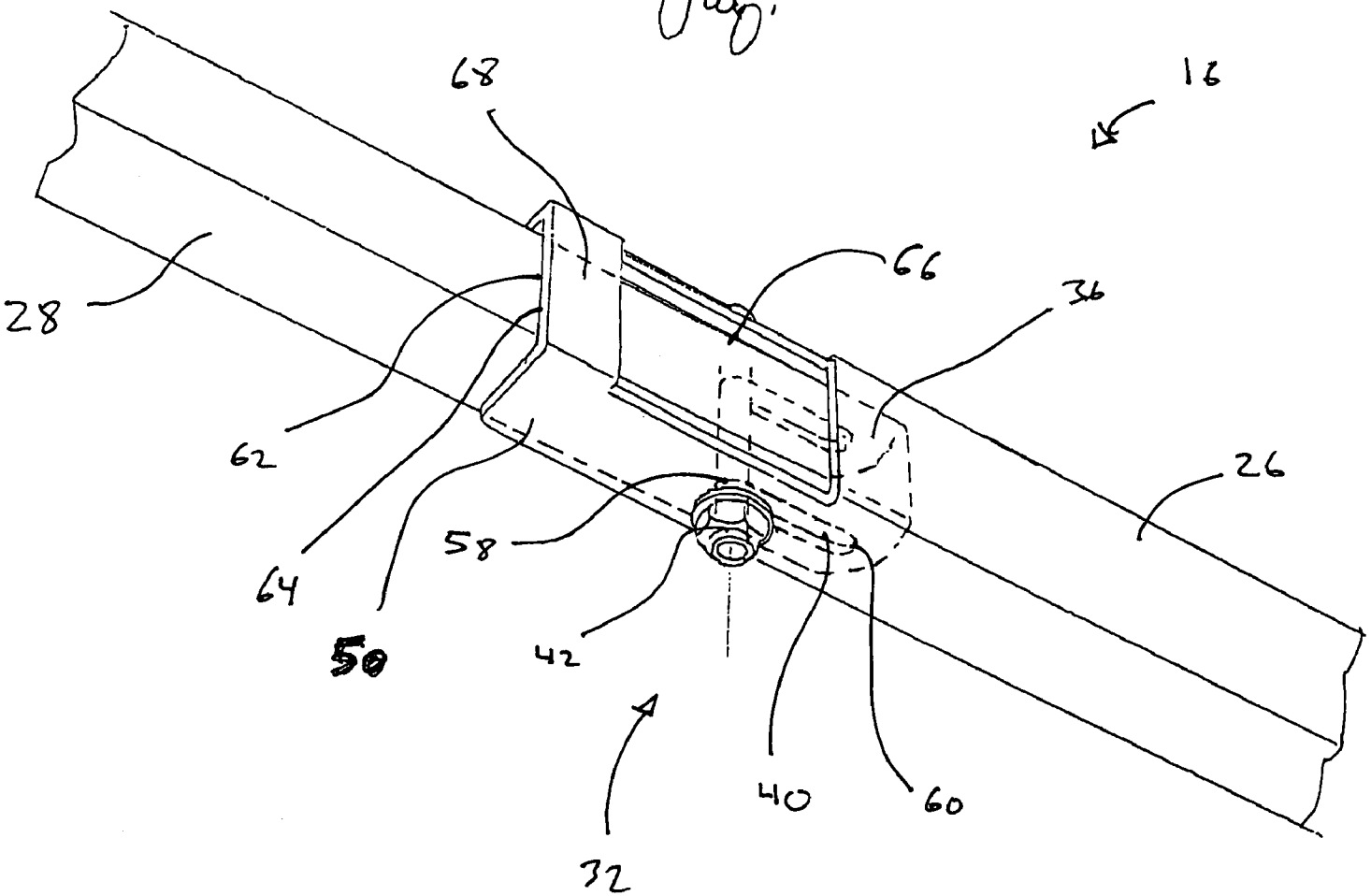
FIG. 2 is a detail perspective taken from the area circled at 2 from FIG. 1.
Figure 3:
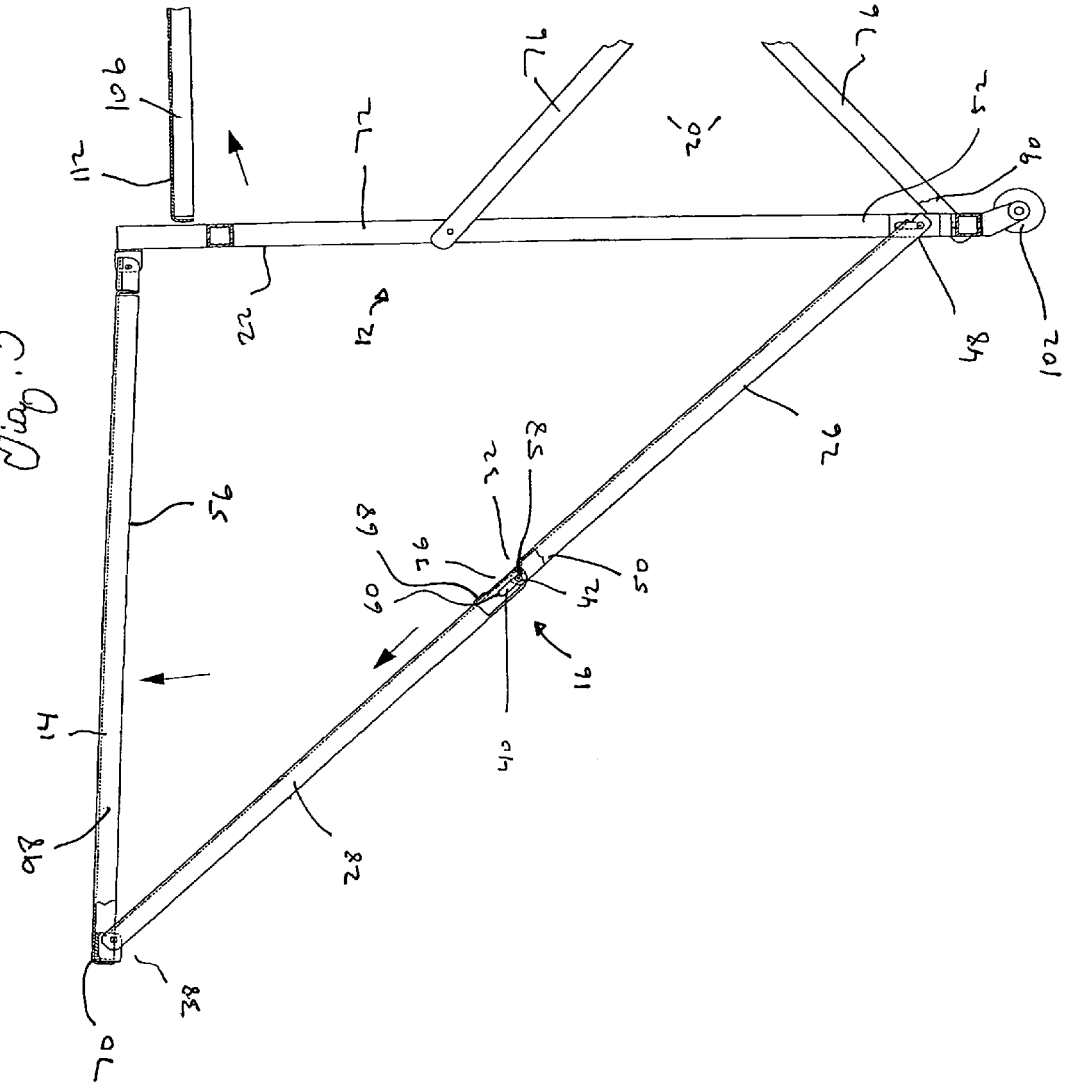
FIG. 3 is a side elevational view of a portion of the invention from FIG. 1.
Figure 4:
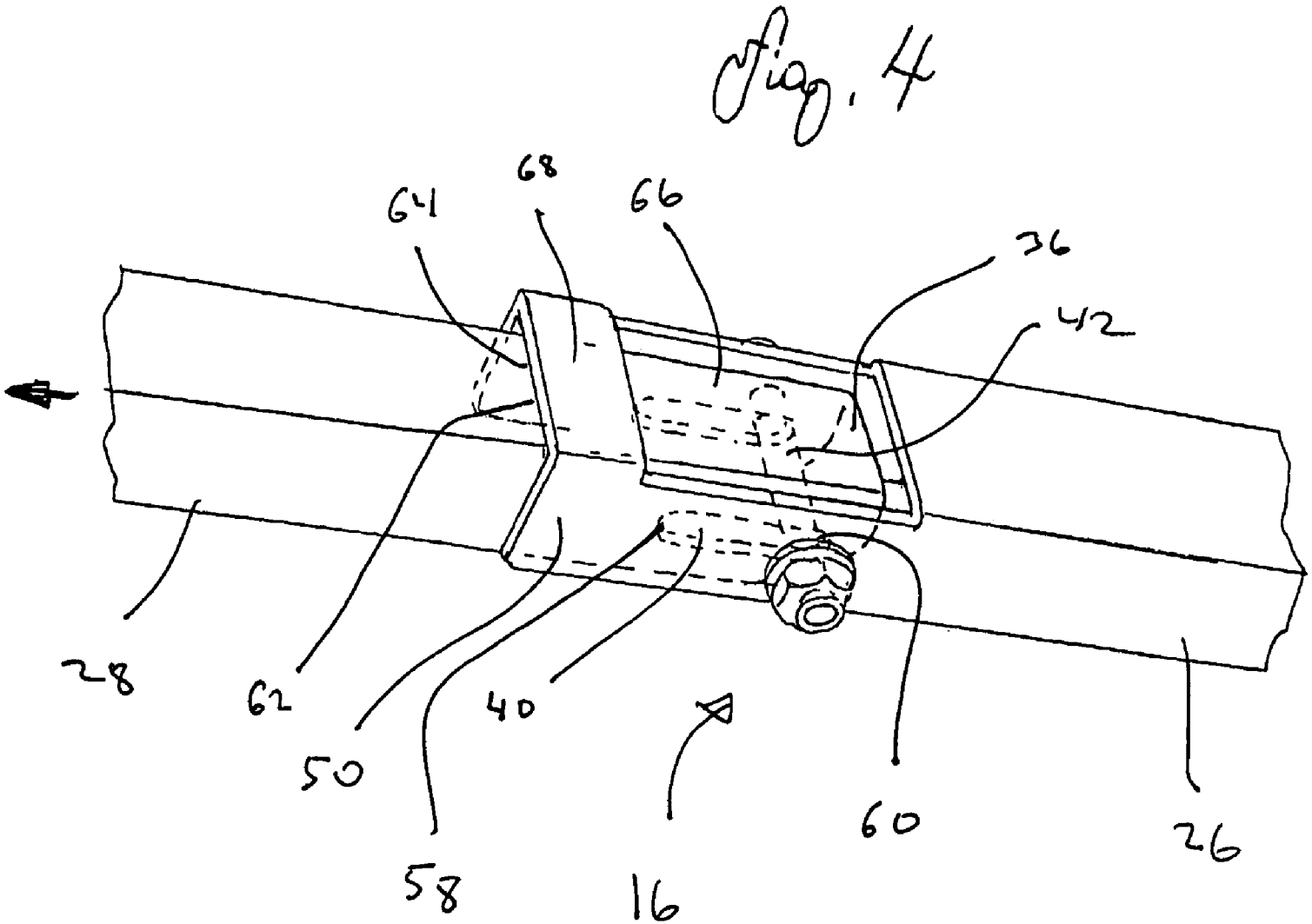
FIG. 4 is a detail perspective of the area shown in FIG. 2.
Figure 5:
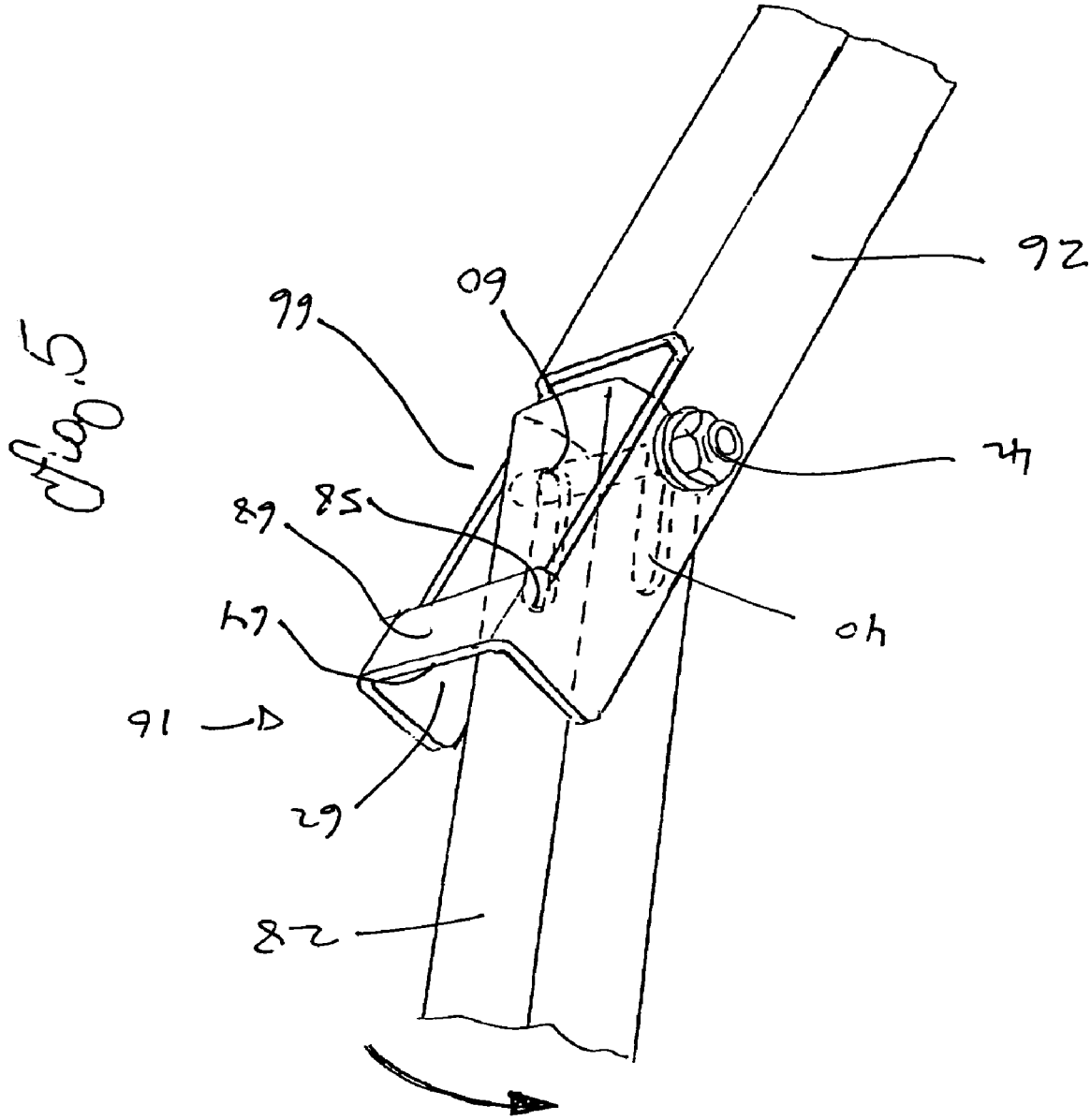
FIG. 5 is a detail perspective of the area shown in FIG. 2.

FIG. 1 illustrates a collapsible table 10 having a support frame 12, a pair of expansion leaves 14 pivotally connected to opposing sides of the support frame 12, and a locking mechanism 16 for selectively maintaining the expansion leaves 14 in an expanded configuration 18.

In FIG. 1, the collapsible table 10 is shown in an expanded configuration 18 wherein the support structure 12 is expanded horizontally by a configurable truss 20. The expansion leaves 14 extend horizontally from opposing sides 22, 24 of the support structure 12. The locking mechanism 16 extends from the support frame 12 to the expansion leaf 14 to maintain the expansion leaf 14 in the expanded configuration 18. Each leaf 14 is supported by a locking mechanism 16 for maintaining a support arm 26 in axial alignment with a corresponding extension arm 28, to support the leaf 14.

Figure 10:
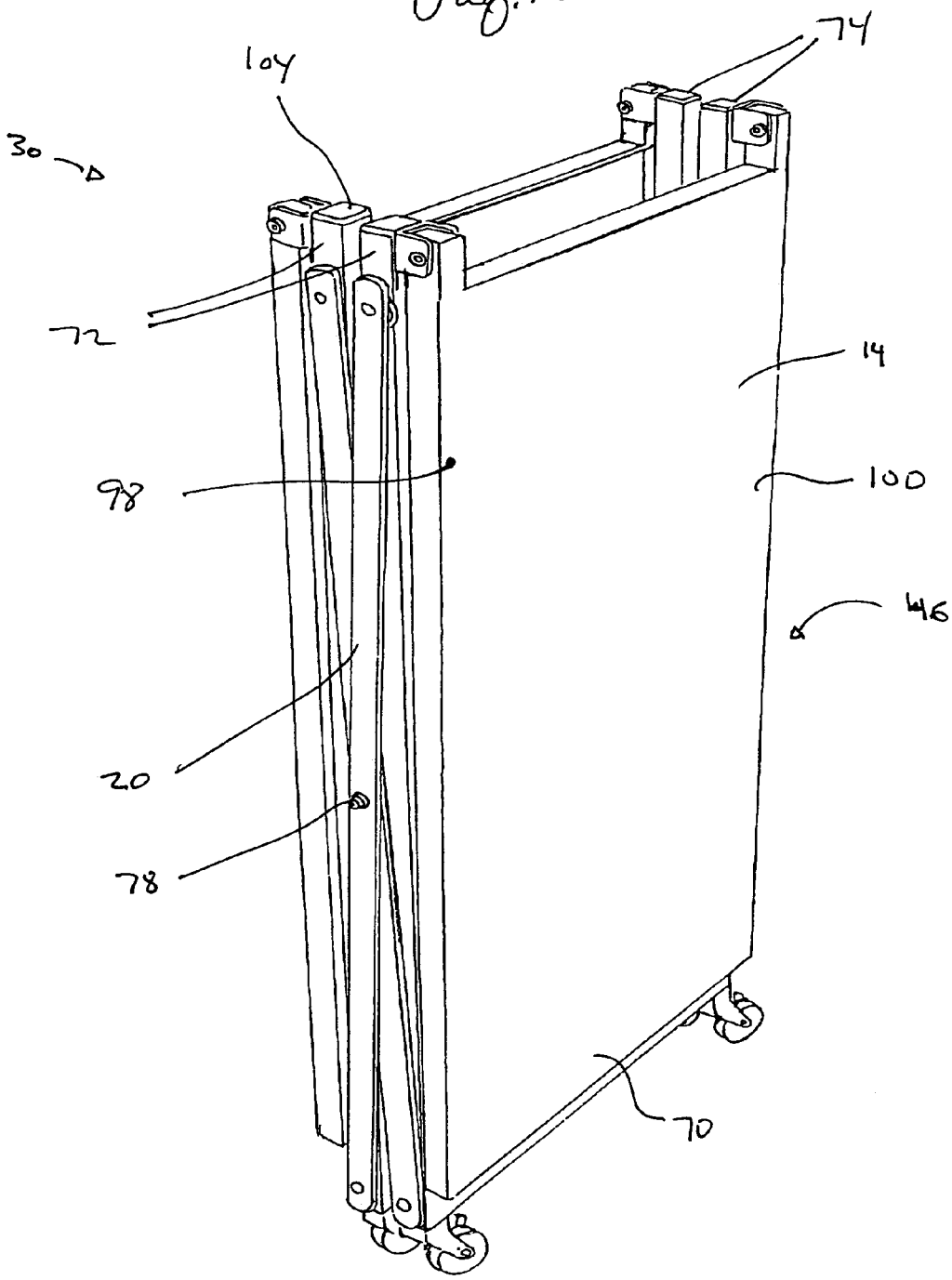
FIG. 10 is a perspective view of the collapsed configuration of the invention from FIG. 1.

In FIG. 10, the collapsible table 10 is shown in a collapsed configuration 30 wherein the support structure 12 is collapsed horizontally about the configurable truss 20. The expansion leaves 14 are pivoted to extend vertically from opposing sides 22, 24 of the support structure 12. The locking mechanism 16 is folded at a pivotable junction 32 between the support arm 28 and extension arm 28 such that the support arm 26 and extension arm 28 are substantially vertical. A stop bar 34 extends from the support structure 12 for maintaining the support arm 26 and extension arm 28 in the vertical position.

The locking mechanism 16 is shown in detail in FIGS. 2–8. Each locking mechanism 16 has a support arm 26 pivotally connected to the support structure 12, and an extension arm 28 pivotally connected at opposing ends 36, 38 to the support arm 26 and the expansion leaf 14, respectively. The pivotable junction 32 is formed where the support arm 26 is pivotally connected to the extension arm 28. The extension arm 28 has a slot 40 configured to slidably receive a pin 42 that extends from the support arm 26. The pin 42 cooperates with the support arm 26 to maintain the extension arm 28 in axial alignment with the support arm 26, when in the expanded configuration 18.

The locking mechanism 16 allows the expansion leaves 14 to be expanded to a horizontal position 44 or collapsed to a vertical position 46. The support arm 26 is pivotally connected at a first end 48 to a lower portion 52 of the support frame 12, on a lower cross bar 54 on the side 22 or 24 of the support frame 12. The support arm 26 extends to a second end 50 that is pivotally connected to a first end 36 of the extension arm 28. The extension arm 28 is pivotally connected at a second end 38 to the underside 56 of the expansion leaf 14. A locking joint 32 is formed where the extension arm 28 is pivotally connected to the support arm 26.

The first end 36 of the extension arm 28 has a slot 40 for receiving a pin 42 that extends from the second end 50 of the support arm 42. In the extended configuration 18, the pin 42 and support arm 26 cooperate to maintain the extension arm 28 in axial alignment with the support arm 26. The slot 40 has an outer, locking end 58, and an inner, pivoting end 60. When the pin 42 engages the outer end 58 of the slot 40, the extension arm 28 slides into a channel 62 in the support arm 26 such that the bottom 64 of the channel 62 engages the extension arm 28. When the pin 42 slides within the slot 40 to the inner, pivoting edge 60, such as by sliding the extension arm 28 away from the support arm 26 along the axis of alignment, the extension arm 28 is able to pivot about the pin 42 with respect to the support arm 26, toward a collapsed configuration 30.

The channel 62 of the support arm 26 is configured such that, in the extended configuration, the channel 62 faces away from the support structure 12. The first end 36 of the extension arm 28 is received within the channel 62. An aperture 66 is defined by a portion of the bottom 64 of the channel 62. A brace 68 is positioned at the second end 50 of the support arm 26 so as to prevent the pivoting of the pivot point 32 in a direction away from the support structure 12 beyond the axial alignment of the support arm 26 and extension arm 28.

The aperture 66 allows the extension arm 28 to pivot within the channel 62 when moved to a collapsed configuration 30. The extension arm 28 is slid away from the support arm 26 such that the pin 42 engages the pivot end 60 of the slot 40. A force F may then be applied to the pivot area 32 to bend the pivot area 32 and move the pivot area 32 toward the support structure 12. As the pivot area 32 moves toward the support structure 12, the second end 50 of the support arm 26 moves toward the stop bar 34, with the first end 36 of the extension arm 28. The second end 38 of the extension arm 26 moves downwardly with the outer end 70 of the expansion leaf 14.

Figure 9:
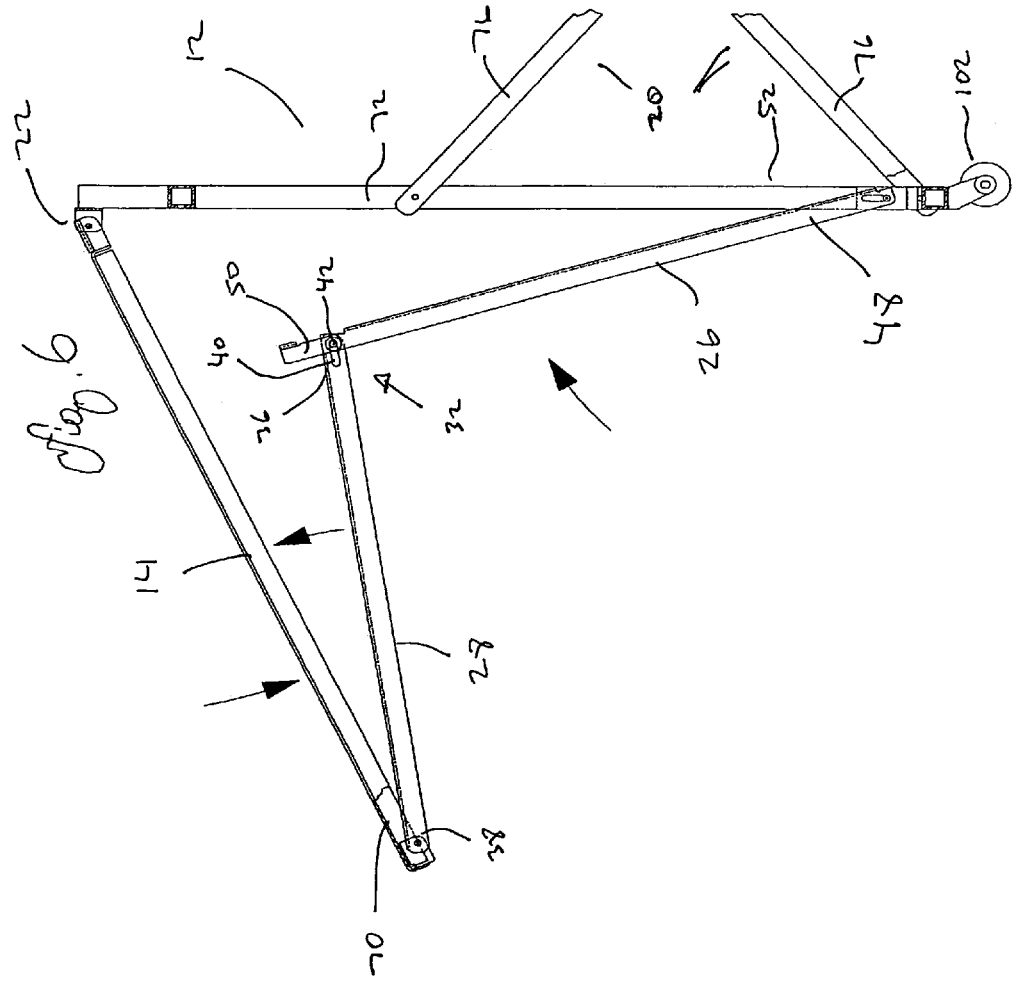
FIG. 9 is a fragmentary perspective of one side in the collapsed configuration of the invention from FIG. 1.
Figure 7:
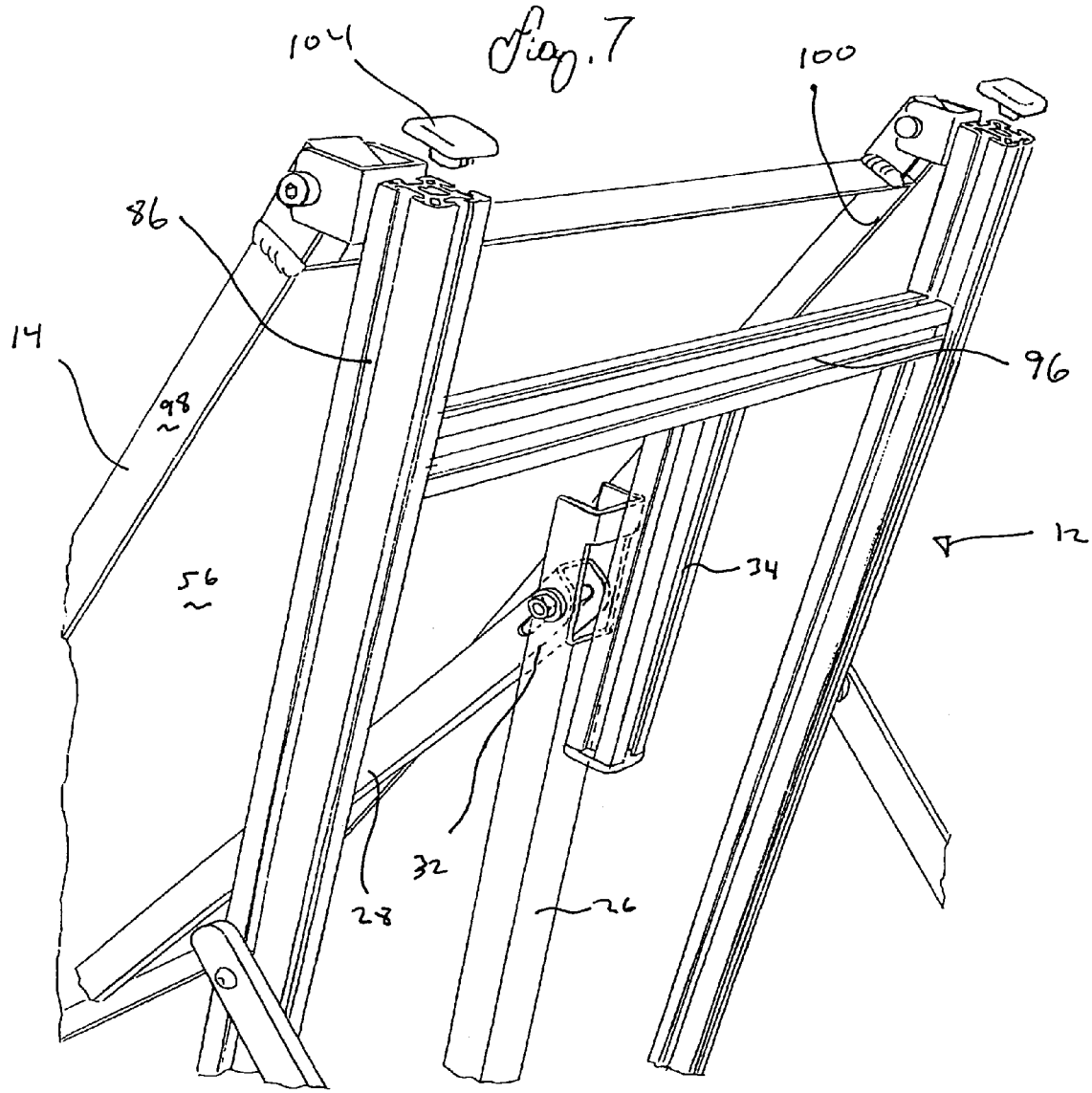
FIG. 7 is a fragmentary perspective view of a portion of the invention from FIG. 1.
Figure 8:
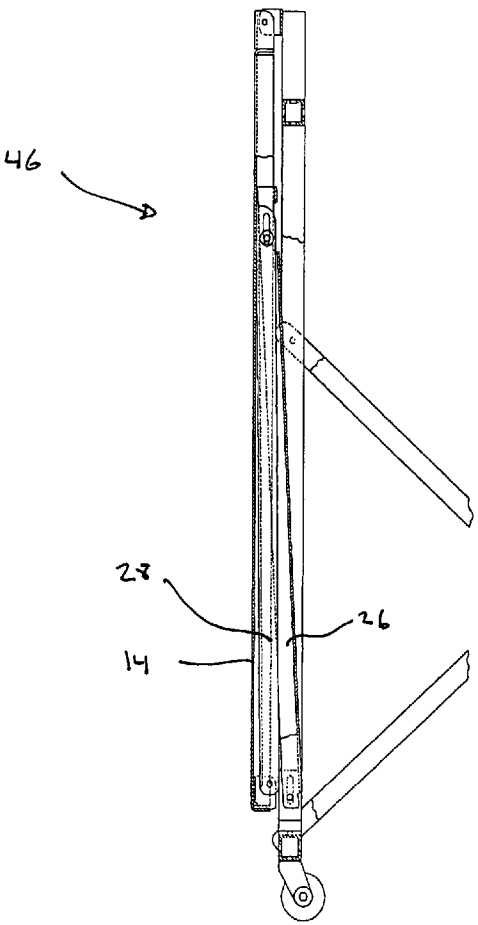
FIG. 8 is a side elevational view of a portion of the invention from FIG. 1.
Figure 9:
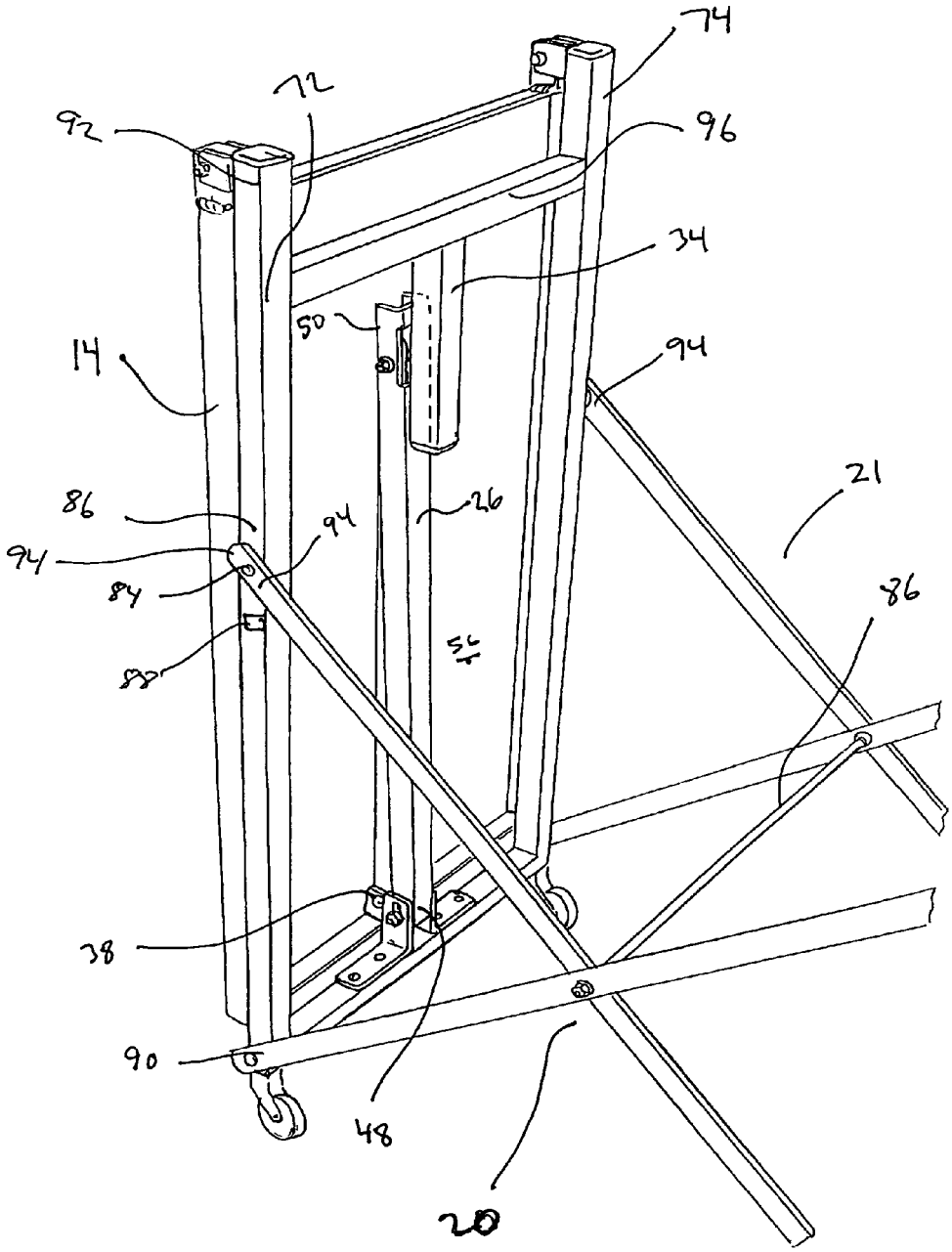

The support structure 12 includes four upright members 72, 74, a front pair 72 and a rear pair 74. As shown in FIG. 9, a configurable truss 20, 21 extends between the front pair 72, and identically between the rear pair 74 of upright members. The configurable truss 20, 21 has two crossing arms 76. Each crossing arm extends angularly from a first upright member 72, 74 to a second upright member 72, 74. The two crossing arms 76 are pivotally connected to each other by a pin 78, forming a pivot point, between the pair of upright members 72, 74. The pin 78 extends from the front configurable truss 20 to the rear configurable truss 21 so as to maintain the trusses 20, 21 in a mirrored relationship.

Each crossing arm 76 has one end 80 that is pivotally fixed to a portion of an upright member 72, 74, and another end 82 that is slidably extendible along the vertical length of the upright member 72, 74. The sliding end 82 is slidably connected to the upright member 72, 74 by a guide member 84 that extends into a channel 86 within the upright members 72, 74. A stopper 88 is positioned within the channel 86 to limit the upward and downward distance that the crossing arm 76 can extend along the length of the upright member 72, 74.

As shown, the lower end 90 of the crossing arms 76 are fixed to the lower portion 52 of the upright members 72, 74 and the upper end 94 of the crossing arms 76 are able to slide along the vertical length of the upright members 72, 74. The configurable truss 20, 21 is able to extend in the horizontal direction wherein the upper end 94 of the crossing arms 76 will slide downwardly along the vertical length of the upright member 72, 74. Conversely, the configurable truss 20, 21 is able to collapse in the vertical direction wherein the upper end 94 of each of the crossing arms 76 will slide upwardly along the vertical length of the upright member 72, 74.

The support structure 12 has crossing bars 54, 96 extending from the front pair of upright members 72 to the rear pair of upright members 74 such that the crossing bars 54, 96 are parallel to each other and perpendicular to the configurable trusses 20, 21.

As shown, there is an upper crossing bar 96 and a lower crossing bar 54 that extends from each of the front upright members 72 to a corresponding rear upright member 74.

A stop bar 34 extends vertically downwardly from each of the upper crossbars 96. The stop bar 34 is able to engage the support arm 26 when in the collapsed configuration 30 to prevent pivoting of the support arm 26 in the direction of the stop bar 34, wherein the support arm 26 abuts against the stop bar 34.

The expansion leaves 14 are pivotally connected to opposing ends 22, 24 of the support structure 12. A front portion 98 of the expansion leaf 14 is pivotally connected to a top portion 92 of the front upright member 72 and a rear portion 100 of the expansion leaf 14 is pivotally connected to a top portion 92 of the rear upright member 74. The expansion leaves 14 have a generally planar top surface and are extendible from a collapsed configuration 30 wherein the expansion leaves 14 are substantially in a vertical position and an expanded configuration 18 wherein the expansion leaves 14 are in a substantially horizontal position.

Each of the upright members 72, 74 of the support structure 12 may alternatively have wheels 102, or instead may have terminating ends 104.

A removable center table piece 106 is configured to be received over the support structure 12. The table piece 106 has two pairs of recesses 108, 110, each pair of recesses 108, 110 for receiving one of the crossing bars 96. The table piece 106 has a generally planar top surface 112. The table piece 106 is maintained over the support structure 12 by the fitting of the recesses 108, 110 over the corresponding crossing bars 96. The table piece 106 maintains the configurable truss 20, 21 in the expanded configuration 18.

In the expanded configuration 18, the vertical height of the removable table piece 106 is lower than the vertical height of the expansion leaves 14. It is contemplated that the table piece 106 is configured as a working table, such as for maintaining a miter saw thereon. Alternatively, the table may be used for recreation.

The table piece 106 may be removed by lifting it upwardly from position over the crossing bars 96.

What is claimed is:

1. A collapsible table alternately configurable in expanded and collapsed configurations, comprising:

(a) a support frame having a horizontally collapsible truss;

(b) an expansion leaf pivotally connected to said support frame;

(c) locking mechanism for maintaining said expansion leaf in a horizontal plane, said locking mechanism comprising a support arm and an extension arm articulated relative to one another, and said locking mechanism being pivotally connected at opposing ends to said support frame and said expansion leaf; and (d) a stop bar which extends from the support frame and is configured to abut a portion of said locking mechanism when the table is in a collapsed configuration.

2. The collapsible table according to claim 1 wherein said extension arm has a slot for receiving a pin extending from said support arm.

3. The collapsible table according to claim 2 wherein said slot has a locking end wherein said pin engages said locking end to maintain said extension arm in axial alignment.

4. The collapsible table according to claim 3 wherein said slot has a pivoting end wherein as said pin engages said pivoting end to allow said extension arm to pivot with respect to said support arm.

5. The collapsible table according to claim 4 wherein said support arm has an aperture for allowing said extension arm to pivot with respect to said support arm.

6. The collapsible table according to claim 5 wherein said support arm has a channel for allowing the extension arm to slid therein.

7. A table support system comprising:

(a) an expansion leaf pivotally connected to a table support frame for movement between expanded and collapsed configurations;

(b) a locking mechanism for maintaining said expansion leaf in said expanded configuration, said locking mechanism comprising:

(i) a support arm pivotally connected, at a first end thereof, to said support frame;

(ii) an extension arm pivotally connected, at a first end thereof, to said expansion leaf;

(iii) a pin slidably received within overlying slots formed in second ends of said support arm and said extension arm, wherein said pin cooperates with said support arm to maintain said extension arm in axial alignment with said support arm; and (c) a stop bar which extends from the support frame and is configured to abut a portion of said locking mechanism when the table is in a collapsed configuration.

8. The table support system according to claim 7 wherein said support arm has a channel for slidably receiving said extension arm.

9. The table support system according to claim 8 wherein said support arm has an aperture for allowing said extension arm to pivot with respect to said support arm.

10. The table support system according to claim 9 wherein said support arm has a brace for maintaining said extension arm in axial alignment with said support arm.

11. An expandible and collapsible table comprising:

(a) an expanded configuration wherein a support frame is expanded horizontally by a configurable truss, a pair of expansion leaves extend horizontally from opposing sides of said support frame, and each of a support arm and an extension arm are axially aligned to extend from a lower portion of said support structure to one of said expansion leaves; and (b) a collapsed configuration wherein said support structure is collapsed horizontally about said configurable truss, and said expansion leaves extend vertically from opposing sides of said support frame, and wherein a cooperating said support arm and said extension arm extend vertically in an overlying relationship and abut against a stop bar extending from said support frame.

12. The expandable and collapsible table according to claim 11 wherein said support arm and said extension arm cooperate to form a locking mechanism.

13. The expandable and collapsible table according to claim 12 wherein said locking mechanism includes a pin slidable within a slot.

14. The expandable and collapsible table according to claim 13 wherein said pin is able to engage a first end of said slot for allowing said extension arm to pivot with respect to said support arm.

15. The expandable and collapsible table according to claim 14 wherein said support arm has an aperture for allowing said extension arm to pivot with respect thereto.

16. The expandable and collapsible table according to claim 13 wherein said pin is able to engage a second end of said slot for maintaining said extension arm in axial alignment with said support arm.

17. The expandable and collapsible table according to claim 16 wherein said support arm has a brace for maintaining said extension arm in axial alignment therewith.

* * * * *